US006135420A

United States Patent [19]

Johnston et al.

[11] Patent Number: 6,135,420

[45] Date of Patent: Oct. 24, 2000

[54] PORTABLE VEHICLE WHEEL RAISING RAMP

[76] Inventors: Wayne L. Johnston, P.O. Box 404, Garnett; Larry C. Jennings, 131 N. Oak, Garnet, both of Kans. 66032

[21] Appl. No.: 09/480,522

[22] Filed: Jan. 7, 2000

[51] Int. Cl.[7] ..... E02C 3/00

[52] U.S. Cl. ..... 254/88

[58] Field of Search ..... 254/88; 188/32; 152/213 R; 14/69.5, 71.1

[56] References Cited

U.S. PATENT DOCUMENTS

| | | | |
|---|---|---|---|
| 1,189,632 | 7/1916 | Seitz | 254/88 |
| 1,505,894 | 3/1994 | Irving | 254/88 |
| 2,012,635 | 8/1935 | Paden | 254/88 |
| 5,297,605 | 3/1994 | Littell | 254/88 |
| 5,341,533 | 8/1994 | Seitz | 254/88 |

*Primary Examiner*—Robert C. Watson

[57] ABSTRACT

A portable vehicle wheel raising ramp for providing a ramp assembly highly useful for raising a wheel of a tandem wheel vehicle. The portable vehicle wheel raising ramp includes a pair of ramp portions. Each of the ramp portions comprises a ramp member having a bottom for resting on a ground surface. The bottom defines a first plane. An inclined wall defines a plane oriented at an angle with respect to the first plane. A resting wall defines a plane oriented substantially parallel to the first plane. The ramp members are pivotally connected together. A pivot structure connects the ramp members in a manner permitting pivoting about an axis lying in the first plane. The ramp members are adapted to pivot between an operative position and a storage position. A latch structure is for holding the ramp members in the storage position. A locking structure is for locking the ramp members in the operative position. A lip is formed on each of the ramp portions for resisting rolling movement of a wheel from an upper surface of the resting wall onto an upper surface of the inclined wall.

13 Claims, 3 Drawing Sheets

PORTABLE VEHICLE WHEEL RAISING RAMP

BACKGROUND OF THE INVENTION

1. Field of the Invention

The present invention relates to vehicle wheel ramps and more particularly pertains to a new portable vehicle wheel raising ramp for providing a ramp assembly highly useful for raising a wheel of a tandem wheel vehicle.

2. Description of the Prior Art

The use of vehicle wheel ramps is known in the prior art. More specifically, vehicle wheel ramps heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,103,870; U.S. Pat. No. 4,031,939; U.S. Pat. No. 5,400,846; U.S. Pat. No. 4,761,847; U.S. Pat. No. 5,297,605; and U.S. Pat. No. Des. 384,483.

While these devices fulfill their respective, particular objectives and requirements, the aforementioned patents do not disclose a new portable vehicle wheel raising ramp. The inventive device includes a pair of ramp portions. Each of the ramp portions comprises a ramp member having a bottom for resting on a ground surface. The bottom defines a first plane. An inclined wall defines a plane oriented at an angle with respect to the first plane. A resting wall defines a plane oriented substantially parallel to the first plane. The ramp members are pivotally connected together. A pivot structure connects the ramp members in a manner permitting pivoting about an axis lying in the first plane. The ramp members are adapted to pivot between an operative position and a storage position. A latch structure is for holding the ramp members in the storage position. A locking structure is for locking the ramp members in the operative position. A lip is formed on each of the ramp portions for resisting rolling movement of a wheel from an upper surface of the resting wall onto an upper surface of the inclined wall.

In these respects, the portable vehicle wheel raising ramp according to the present invention substantially departs from the conventional concepts and designs of the prior art, and in so doing provides an apparatus primarily developed for the purpose of providing a ramp assembly highly useful for raising a wheel of a tandem wheel vehicle.

SUMMARY OF THE INVENTION

In view of the foregoing disadvantages inherent in the known types of vehicle wheel ramps now present in the prior art, the present invention provides a new portable vehicle wheel raising ramp construction wherein the same can be utilized for providing a ramp assembly highly useful for raising a wheel of a tandem wheel vehicle.

The general purpose of the present invention, which will be described subsequently in greater detail, is to provide a new portable vehicle wheel raising ramp apparatus and method which has many of the advantages of the vehicle wheel ramps mentioned heretofore and many novel features that result in a new portable vehicle wheel raising ramp which is not anticipated, rendered obvious, suggested, or even implied by any of the prior art vehicle wheel ramps, either alone or in any combination thereof.

To attain this, the present invention generally comprises a pair of ramp portions. Each of the ramp portions comprises a ramp member having a bottom for resting on a ground surface. The bottom defines a first plane. An inclined wall defines a plane oriented at an angle with respect to the first plane. A resting wall defines a plane oriented substantially parallel to the first plane. The ramp members are pivotally connected together. A pivot structure connects the ramp members in a manner permitting pivoting about an axis lying in the first plane. The ramp members are adapted to pivot between an operative position and a storage position. A latch structure is for holding the ramp members in the storage position. A locking structure is for locking the ramp members in the operative position. A lip is formed on each of the ramp portions for resisting rolling movement of a wheel from an upper surface of the resting wall onto an upper surface of the inclined wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable vehicle wheel raising ramp apparatus and method which has many of the advantages of the vehicle wheel ramps mentioned heretofore and many novel features that result in a new portable vehicle wheel raising ramp which is not anticipated, rendered obvious, suggested, or even implied by any of the prior art vehicle wheel ramps, either alone or in any combination thereof.

It is another object of the present invention to provide a new portable vehicle wheel raising ramp which may be easily and efficiently manufactured and marketed.

It is a further object of the present invention to provide a new portable vehicle wheel raising ramp which is of a durable and reliable construction.

An even further object of the present invention is to provide a new portable vehicle wheel raising ramp which is susceptible of a low cost of manufacture with regard to both materials and labor, and which accordingly is then susceptible of low prices of sale to the consuming public, thereby making such portable vehicle wheel raising ramp economically available to the buying public.

Still yet another object of the present invention is to provide a new portable vehicle wheel raising ramp which provides in the apparatuses and methods of the prior art some of the advantages thereof, while simultaneously overcoming some of the disadvantages normally associated therewith.

Still another object of the present invention is to provide a new portable vehicle wheel raising ramp for providing a ramp assembly highly useful for raising a wheel of a tandem wheel vehicle.

Yet another object of the present invention is to provide a new portable vehicle wheel raising ramp which includes a pair of ramp portions. Each of the ramp portions comprises a ramp member having a bottom for resting on a ground surface. The bottom defines a first plane. An inclined wall defines a plane oriented at an angle with respect to the first plane. A resting wall defines a plane oriented substantially parallel to the first plane. The ramp members are pivotally connected together. A pivot structure connects the ramp members in a manner permitting pivoting about an axis lying in the first plane. The ramp members are adapted to pivot between an operative position and a storage position. A latch structure is for holding the ramp members in the storage position. A locking structure is for locking the ramp members in the operative position. A lip is formed on each of the ramp portions for resisting rolling movement of a wheel from an upper surface of the resting wall onto an upper surface of the inclined wall.

Still yet another object of the present invention is to provide a new portable vehicle wheel raising ramp that permits a vehicle wheel to be driven in the same direction when mounting and dismounting the ramp assembly.

Even still another object of the present invention is to provide a new portable vehicle wheel raising ramp that provides a distinctive indication to the vehicle driver that the wheel has reached the top of the ramp assembly and when the wheel rolls past the top of the ramp.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
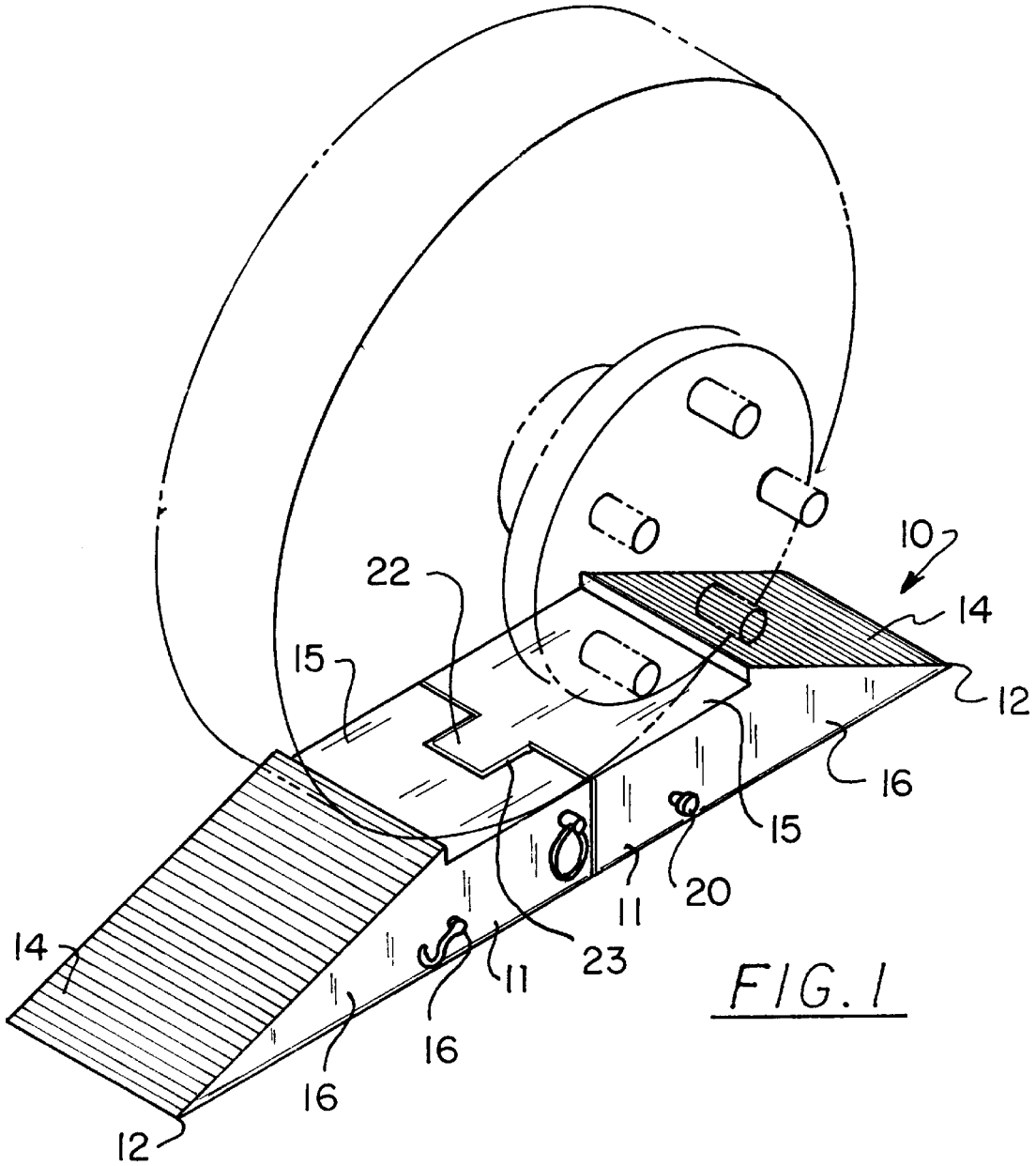
FIG. 1 is a perspective view of a new portable vehicle wheel raising ramp in the operative position according to the present invention.
Figure 2:
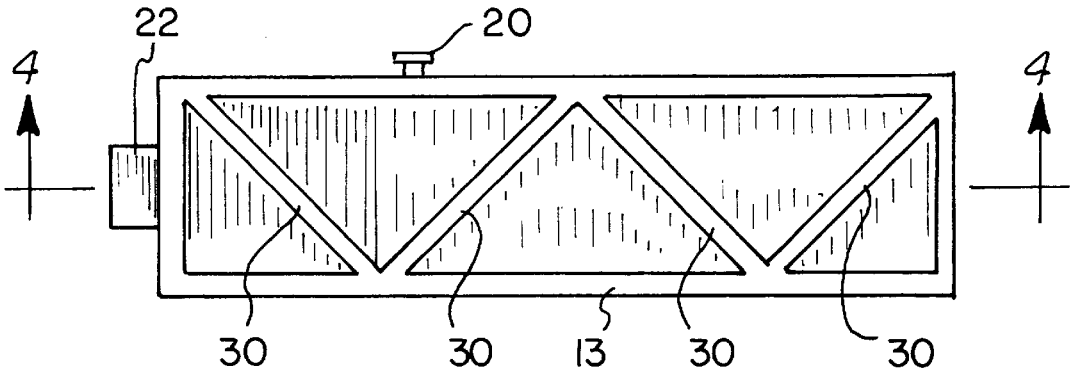
FIG. 2 is a bottom plan view of one of the ramp members of the present invention.
Figure 4:
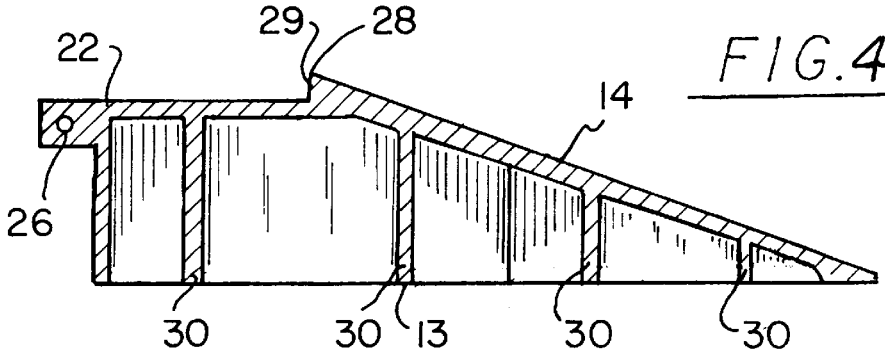
FIG. 4 is a cross-sectional view one of the ramp members of the present invention along line 4—4 of FIG. 2.

With reference now to the drawings, and in particular to FIGS. 1 through 4 thereof, a new portable vehicle wheel raising ramp embodying the principles and concepts of the present invention and generally designated by the reference numeral 10 will be described.

As best illustrated in FIGS. 1 through 4, the portable vehicle wheel raising ramp 10 generally comprises a pair of ramp portions 11. each of the ramp portions comprises a ramp member 12. Each ramp member comprises a bottom 13 for resting on a ground surface. The bottom defines a first plane. An inclined wall 14 defines a plane oriented at an angle with respect to the first plane. A resting wall 15 defines a plane oriented substantially parallel to the first plane. The resting wall has a length of 10 inches. A pair of laterally separated side walls 16 are oriented substantially perpendicular to the first plane and the plane of the resting wall. An end wall 17 extends between the side walls. Each of the ramp members has a length of 18 to 20 inches and a width of 10 inches.

The ramp members are pivotally connected together. A pivot structure 18, such as a piano hinge, connects the ramp members in a manner permitting pivoting about an axis lying in the first plane. The ramp members are adapted to pivot between an operative position and a storage position. The operative position is characterized by the resting wall of each of the ramp members being oriented in substantially the same plane. The operative position is characterized by the end wall of each of the ramp members being oriented substantially parallel and substantially adjacent to each other. The storage position is characterized by the bottom of each of the ramp members being positioned adjacent to each other.

A latch structure holds the ramp members in the storage position. The latch structure includes a hook member 19 mounted on one of the side walls of one of the ramp members. A post 20 is mounted on one of the side walls of the other one of the ramp members. The hook member is pivotally mounted such that the hook member may be pivoted to engage the post when the ramp members are positioned in the storage position.

Figure 3:
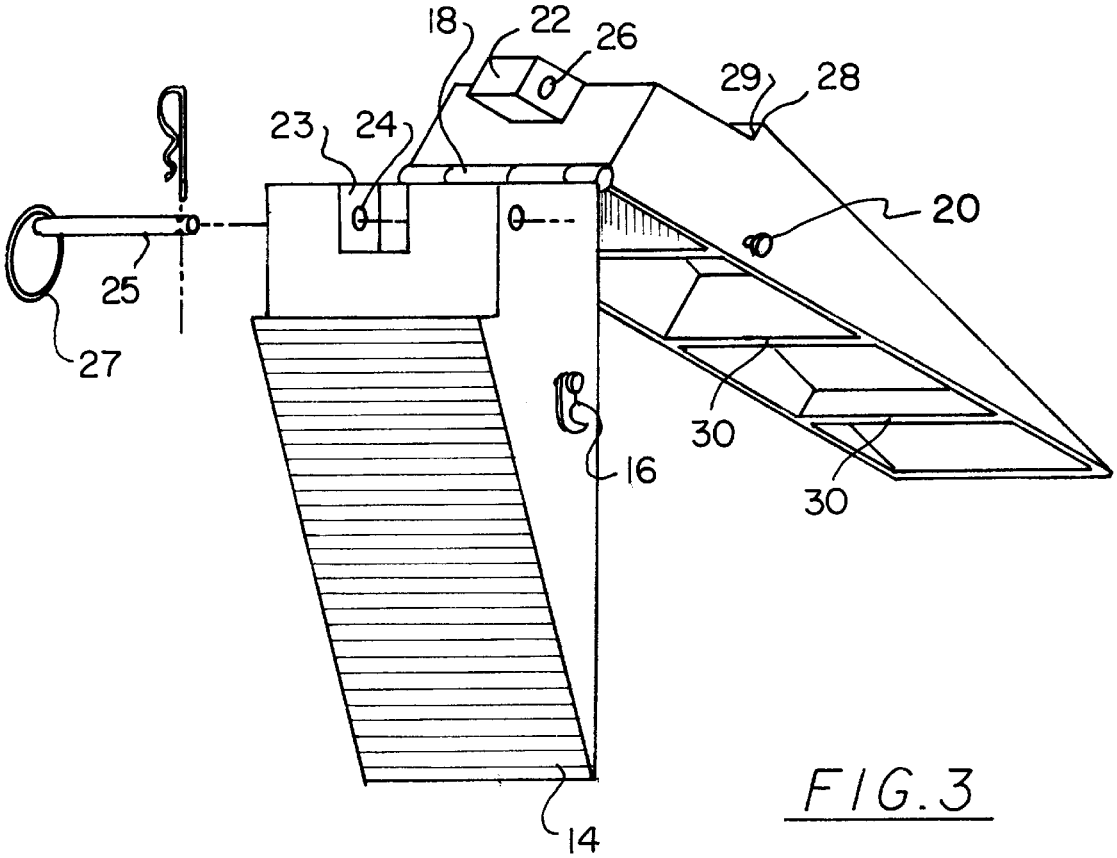
FIG. 3 is a perspective view of the present invention.

As shown in FIG. 3, a locking structure 21 is for locking the ramp members in the operative position. The locking structure includes a protrusion 22 formed on a first one of the ramp members and a recess 23 formed on a second one of the ramp members. The protrusion is adapted to receive the recess when the ramp members are in the operative position. A first locking channel 24 is formed in the second ramp member for receiving a locking pin 25. The locking pin extends across the recess when the locking pin is inserted in the first locking channel. The protrusion comprises a second locking channel 26 that is axially alignable with the first locking channel when the ramp members are positioned in the operative position. The insertion of the locking pin through the first and second channels locks the ramp members in the operative position and removal of the locking pin from the first and second locking channels permits movement of the ramp members from the operative position to the storage position. A pull ring 27 extends through an end of the locking pin for permitting pulling of the locking pin in an axial direction. The protrusion and the recess are each formed on the end wall of the respective ramp member.

A lip 28 is formed on each of the ramp portions for resisting rolling movement of a wheel from an upper surface of the resting wall onto an upper surface of the inclined wall.

The lip is located between an upper surface of the inclined wall and an upper surface of the resting surface. Each of the lips includes a lip wall 29 extending in a substantially perpendicular direction with respect to the resting wall.

Each of the ramp members has a plurality of reinforcing walls 30 extending between the side walls for supporting the inclined wall. At least one of the reinforcing walls are oriented at an acute angle with respect to the side walls of the ramp member. In an embodiment the reinforcing walls extend perpendicular to the side walls.

In use, the user takes the pair of ramp members and moves the hook member so that it disengages the post thereby allowing the ramp member to be moved from the stored position to the operative position. The user then inserts the locking pin through the first locking channel to engage the second locking channel thereby locking the ramp members in the operative position. The ramp members are then placed behind or in front of one of the wheels of tandem wheeled vehicle and the vehicle is then driven up the ramp members. As the driver drives over the lip he is alerted by the sudden change in height of the wheel that the vehicle is on the resting walls. Work can then be done on the wheel. When work on the wheel is completed the vehicle is then driven off of the ramp members and the locking pin is removed and the ramp members are pivoted to the storage position and secured.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A ramp assembly, comprising:

a pair of ramp portions, each of the ramp portions comprising:

a ramp member having a bottom for resting on a ground surface, the bottom defining a first plane, an inclined wall defining a plane oriented at an angle with respect to the first plane, a resting wall defining a plane oriented substantially parallel to the first plane;

wherein the ramp members are pivotally connected together, a pivot structure connecting the ramp members in a manner permitting pivoting about an axis lying in the first plane, the ramp members being adapted to pivot between an operative position and a storage position;

a latch structure for holding the ramp members in the storage position;

a locking structure for locking the ramp members in the operative position; and a lip formed on each of the ramp portions for resisting rolling movement of a wheel from an upper surface of the resting wall onto an upper surface of the inclined wall.

2. The ramp assembly as set forth in claim 1, wherein each ramp member comprises a pair of laterally separated side walls oriented substantially perpendicular to the first plane and the plane of the resting wall, an end wall extending between the side walls.

3. The ramp assembly as set forth in claim 2, wherein each of the ramp members has a plurality of reinforcing walls extending between the side walls for supporting the inclined wall, at least one of the reinforcing walls being oriented at an acute angle with respect to the side walls of the ramp member.

4. The ramp assembly as set forth in claim 1, wherein the operative position is characterized by the resting wall of each of the ramp members being oriented in substantially the same plane, the operative position being characterized by the end wall of each of the ramp members being oriented substantially parallel and substantially adjacent to each other.

5. The ramp assembly as set forth in claim 1, wherein the storage position is characterized by the bottom of each of the ramp members being positioned adjacent to each other.

6. The ramp assembly as set forth in claim 1, wherein the latch structure includes a hook member mounted on one of the side walls of one of the ramp members, a post mounted on one of the side walls of the other one of the ramp members, the hook member being pivotally mounted such that the hook member may be pivoted to engage the post when the ramp members are positioned in the storage position.

7. The ramp assembly as set forth in claim 1, wherein the locking structure includes a protrusion formed on a first one of the ramp members and a recess formed on a second one of the ramp members, the protrusion being adapted to receive the recess when the ramp members are in the operative position.

8. The ramp assembly as set forth in claim 7, wherein the locking structure includes a locking pin, a first locking channel formed in the second ramp member for receiving the locking pin, the locking pin extending across the recess when the locking pin is inserted in the first locking channel.

9. The ramp assembly as set forth in claim 8, wherein the protrusion has a second locking channel that is axially alignable with the first locking channel when the ramp members are positioned in the operative position such that insertion of the locking pin through the first and second channels locks the ramp members in the operative position and removal of the locking pin from the first and second locking channels permits movement of the ramp members from the operative position to the storage position.

10. The ramp assembly as set forth in claim 8, wherein a pull ring extends through an end of the locking pin for permitting pulling of the locking pin in an axial direction.

11. The ramp assembly as set forth in claim 8, wherein the protrusion and the recess are each formed on the end wall of the respective ramp member.

12. The ramp assembly as set forth in claim 1, wherein the lip is located between an upper surface of the inclined wall and an upper surface of the resting surface, each of the lips including a lip wall extending in a substantially perpendicular direction with respect to the resting wall.

13. A ramp assembly, comprising:

a pair of ramp portions, each of the ramp portions comprising:

a ramp member having a bottom for resting on a ground surface, the bottom defining a first plane, an inclined wall defining a plane oriented at an angle with respect to the first plane, a resting wall defining a plane oriented substantially parallel to the first plane, a pair of laterally separated side walls oriented substantially perpendicular to the first plane and the plane of the resting wall, an end wall extending between the side walls;

wherein the ramp members are pivotally connected together, a pivot structure connecting the ramp members in a manner permitting pivoting about an axis lying in the first plane, the ramp members being adapted to pivot between an operative position and a storage position, the operative position being characterized by the resting wall of each of the ramp members being oriented in substantially the same plane, the operative position being characterized by the end wall of each of the ramp members being oriented substantially parallel and substantially adjacent to each other, the storage position being characterized by the bottom of each of the ramp members being positioned adjacent to each other;

a latch structure for holding the ramp members in the storage position, the latch structure including a hook member mounted on one of the side walls of one of the ramp members, a post mounted on one of the side walls of the other one of the ramp members, the hook member being pivotally mounted such that the hook member may be pivoted to engage the post when the ramp members are positioned in the storage position;

a locking structure for locking the ramp members in the operative position, the locking structure including a protrusion formed on a first one of the ramp members and a recess formed on a second one of the ramp members, the protrusion being adapted to receive the recess when the ramp members are in the operative position, a locking pin, a first locking channel formed in the second ramp member for receiving the locking pin, the locking pin extending across the recess when the locking pin is inserted in the first locking channel, the protrusion having a second locking channel that is axially alignable with the first locking channel when the ramp members are positioned in the operative position such that insertion of the locking pin through the first and second channels locks the ramp members in the operative position and removal of the locking pin from the first and second locking channels permits movement of the ramp members from the operative position to the storage position, a pull ring extending through an end of the locking pin for permitting pulling of the locking pin in an axial direction, wherein the protrusion and the recess are each formed on the end wall of the respective ramp member, a lip formed on each of the ramp portions for resisting rolling movement of a wheel from an upper surface of the resting wall onto an upper surface of the inclined wall, the lip being located between an upper surface of the inclined wall and an upper surface of the resting surface, each of the lips including a lip wall extending in a substantially perpendicular direction with respect to the resting wall, wherein each of the ramp members has a plurality of reinforcing walls extending between the side walls for supporting the inclined wall, at least one of the reinforcing walls being oriented at an acute angle with respect to the side walls of the ramp member.

* * * * *